US011248333B2

(12) United States Patent
Dulberg et al.

(10) Patent No.: US 11,248,333 B2
(45) Date of Patent: Feb. 15, 2022

(54) STEAM COMPRESSION DRYER

(71) Applicant: WATERGEN Ltd., Petah Tikva (IL)

(72) Inventors: Sharon Dulberg, Beer Sheva (IL); Arye Kohavi, Newe Monosson (IL)

(73) Assignee: WATERGEN LTD., Petah Tikva (IL)

( * ) Notice: Subject to any disclaimer, the term of this patent is extended or adjusted under 35 U.S.C. 154(b) by 341 days.

(21) Appl. No.: 16/212,635

(22) Filed: Dec. 6, 2018

(65) Prior Publication Data

US 2019/0112752 A1 Apr. 18, 2019

Related U.S. Application Data

(62) Division of application No. 14/950,109, filed on Nov. 24, 2015, now Pat. No. 10,151,060.

(51) Int. Cl.
*D06F 58/20* (2006.01)
*F26B 21/00* (2006.01)
(Continued)

(52) U.S. Cl.
CPC ..... *D06F 58/20* (2013.01); *F26B 21/002* (2013.01); *D06F 37/42* (2013.01); *D06F 58/206* (2013.01);
(Continued)

(58) Field of Classification Search
CPC .. D06F 2103/08; D06F 58/30; D06F 2101/14; D06F 2105/24; D06F 58/24;
(Continued)

(56) References Cited

U.S. PATENT DOCUMENTS 2,154,481 A * 4/1939 Vorkauf ..... F01K 11/04 60/39.182
3,089,327 A * 5/1963 Stilwell, Jr. ..... D06F 37/06 68/139
(Continued)

FOREIGN PATENT DOCUMENTS

DE 199 13 938 9/2000
DE 202 02 782 4/2002
(Continued)

OTHER PUBLICATIONS

European Search Report of Application No. EP 16 20 0585 dated Apr. 24, 2017.
(Continued)

*Primary Examiner* — Jorge A Pereiro
*Assistant Examiner* — Bao D Nguyen
(74) *Attorney, Agent, or Firm* — Pearl Cohen Zedek Latzer Baratz LLP

(57) ABSTRACT

A dryer apparatus is disclosed comprising a container having a container inlet and outlet, a pump that is configured to motivate a first air-vapor mixture flow via the container inlet and via the container outlet, a heating device configured to heat the first air-vapor mixture, a selector with at least two states, a compressor that is configured to compress and motivate a part of the first air-vapor mixture flow as a second air-vapor mixture flow, to flow through a first heat exchanger and to flow through a second heat exchanger and a pressure reducing device that is configured to reduce the pressure of said second air-vapor mixture downstream said first heat exchanger. The selector is configured to direct most of the first air-vapor mixture to flow in a closed cycle through the container, or configured to exchange most of the first air-vapor mixture with air located outside the apparatus.

5 Claims, 9 Drawing Sheets

(51) Int. Cl.

| | |
|---|---|
| *D06F 58/38* | (2020.01) |
| *D06F 101/14* | (2020.01) |
| *D06F 103/08* | (2020.01) |
| *D06F 103/36* | (2020.01) |
| *D06F 103/38* | (2020.01) |
| *D06F 105/24* | (2020.01) |
| *D06F 103/10* | (2020.01) |
| *D06F 103/30* | (2020.01) |
| *D06F 103/32* | (2020.01) |
| *D06F 103/34* | (2020.01) |
| *D06F 105/58* | (2020.01) |
| *D06F 37/42* | (2006.01) |
| *D06F 58/26* | (2006.01) |

(52) U.S. Cl.
CPC ..... *D06F 58/26* (2013.01); *D06F 58/38* (2020.02); *D06F 2101/14* (2020.02); *D06F 2103/08* (2020.02); *D06F 2103/10* (2020.02); *D06F 2103/30* (2020.02); *D06F 2103/32* (2020.02); *D06F 2103/34* (2020.02); *D06F 2103/36* (2020.02); *D06F 2103/38* (2020.02); *D06F 2105/24* (2020.02); *D06F 2105/58* (2020.02)

(58) Field of Classification Search
CPC .... D06F 58/26; D06F 58/206; D06F 2103/38; D06F 2103/36; D06F 58/38; D06F 58/32; D06F 58/48; D06F 2103/50; D06F 2058/2812; D06F 2058/2829; D06F 2058/2864; D06F 2058/2896; D06F 58/20; F26B 21/002; F26B 23/004
USPC ..... 34/469, 134
See application file for complete search history.

(56) References Cited

U.S. PATENT DOCUMENTS

| | | | | | |
|---|---|---|---|---|---|
| 3,206,950 | A * | 9/1965 | Xeros | D06F 43/00 | 68/12.09 |
| 3,509,639 | A * | 5/1970 | Arendt | D06F 58/08 | 34/129 |
| 4,242,808 | A * | 1/1981 | Luthi | F26B 23/004 | 34/459 |
| 4,447,965 | A * | 5/1984 | Bray | D06F 58/02 | 34/416 |
| 5,217,065 | A * | 6/1993 | Green | F28D 3/04 | 165/117 |
| 5,228,211 | A * | 7/1993 | Stubbing | D06F 51/00 | 34/443 |
| 5,291,668 | A * | 3/1994 | Becker | F26B 23/004 | 34/86 |
| 5,636,449 | A * | 6/1997 | Gaddis | F26B 11/0445 | 34/124 |
| 5,655,718 | A * | 8/1997 | Anderson | B01J 19/28 | 241/17 |
| 6,112,426 | A * | 9/2000 | Buttazzi | F26B 23/004 | 34/62 |
| 6,161,306 | A * | 12/2000 | Clodic | D06F 39/008 | 34/138 |
| 6,585,871 | B1 * | 7/2003 | Anzaki | C23C 14/027 | 204/192.1 |
| 6,904,703 | B2 * | 6/2005 | Naganawa | D06F 43/086 | 34/596 |
| 6,944,969 | B2 * | 9/2005 | Clodic | F26B 23/004 | 34/513 |
| 8,650,770 | B1 * | 2/2014 | Levy | F26B 23/004 | 34/454 |
| 2003/0099275 | A1 * | 5/2003 | De Aguiar | F26B 21/06 | 374/16 |
| 2005/0072020 | A1 * | 4/2005 | Clodic | F26B 23/004 | 34/140 |
| 2008/0235977 | A1 * | 10/2008 | Kuwabara | D06F 58/206 | 34/77 |
| 2013/0125412 | A1 * | 5/2013 | Haarlemmer | F26B 3/205 | 34/477 |
| 2014/0310979 | A1 * | 10/2014 | Bergset | C01F 11/185 | 34/487 |

FOREIGN PATENT DOCUMENTS

| | | |
|---|---|---|
| DE | 10 2007 016077 | 10/2008 |
| DE | 10 2008 004459 | 7/2009 |
| DE | 10 2008 043176 | 4/2010 |
| EP | 0 467 188 | 1/1992 |
| EP | 2 267 207 | 12/2010 |
| EP | 2511636 A1 | 10/2012 |
| GB | 570 541 | 7/1945 |
| GB | 2 375 812 | 11/2002 |
| WO | WO 2000026595 | 5/2000 |
| WO | WO 2010118965 | 10/2010 |
| WO | WO 2015/136393 | 9/2015 |

OTHER PUBLICATIONS

European Search Report of Application No. EP 15 76 0660 dated Nov. 17, 2017.
U.S. Office Action for U.S. Appl. No. 15/950,109, dated Nov. 22, 2017.

* cited by examiner

STEAM COMPRESSION DRYER

CROSS REFERENCE TO RELATED APPLICATIONS

This application claims priority from U.S. patent application Ser. No. 14/950,109, filed on Nov. 24, 2015 (entitled STEAM COMPRESSION DRYER), which is incorporated in its entirety herein by reference.

FIELD OF THE INVENTION

The present invention relates generally to drying of materials, and particularly to methods and systems for efficient drying of fibrous materials such as wet laundry.

BACKGROUND OF THE INVENTION

The current invention originates from mechanical steam compression dryers.

Mechanical steam compression dryers use water in the form of steam which is recovered from a tumble drying process (such as a laundry dryer). First, a tumbler and its contents are heated to near 100° C. The saturated steam which is created replaces most of the air in the tumbler's volume. As saturated steam flow exits the tumbler, part of the flow is mechanically compressed increasing its temperature. The compressed steam flow is passed in a heat exchanger where it transfers its condensation latent heat to the main steam flow, later expanding. Liquefied water resulting from the condensation gathers in a drawer or is drained. The main flow of steam is superheated in the heat exchanger and is injected back into the tumbler. There, its heat causes more water to vaporize from the clothing, creating more wet steam and restarting the cycle.

SUMMARY OF THE INVENTION

A dryer apparatus according to some embodiments of the present invention is disclosed comprising a container (30), configured to receive material to be dried (40) and having a container inlet (50) and a container outlet (42), a pump (110) that is configured to motivate a first air-vapor mixture flow via the container inlet through said material and via the container outlet (40), a heating device (130) that is configured to heat said first air-vapor mixture, a selector (100) with at least two states, a compressor (140) that is configured to compress and motivate a part of said first air-vapor mixture flow as a second air-vapor mixture flow to flow through a first heat exchanger (120) and through a second heat exchanger (160) and a pressure reducing device (150) that is configured to reduce the pressure of said second air-vapor mixture downstream said first heat exchanger (120). The selector (100) has two states. In a first state, it directs most of the said first air-vapor mixture to flow from said container outlet to said container inlet in a closed cycle, and in its second state, it exchanges most of the said first air-vapor mixture with air located outside the apparatus or enables to transfer part of the heat from said first air-vapor mixture toward a fluid located outside the apparatus. The first heat exchanger is configured to transfer heat between the compressed second air-vapor mixture toward said first air-vapor mixture, and the second heat exchanger is configured to transfer heat from the second air-vapor mixture toward fluid originated from outside of the apparatus.

According to an embodiment of the invention, part of the second air-vapor mixture condenses creating a gas and liquid mixture within the first and/or second heat exchanger. Additionally, the gas and liquid mixture are separated using a separator to a gas portion and a liquid portion. The gas portion may return to the first air-vapor mixture according to some embodiments.

According to some embodiments of the invention, the apparatus further comprises a controller to control at least some of the apparatus components and/or indicators.

A method for operating a dryer is disclosed, including at least three main phases.

- In an Initial Phase, heating a circulating said first air-vapor using a heater.
- In a Drying Phase, which follows the Initial Phase, heating a circulating said first air-vapor in a first heat exchanger by heat from said second compressed air-vapor mixture.
- In a Cooling Phase, occurring after the Drying Initial Phase, cooling the materials to be dried by a fluid originating externally to the dryer or by exchanging heat to said fluid.

According to some embodiments of the invention, the method further comprises an Over Drying Phase which occurs between the Drying Phase and the Cooling Phase wherein said air-vapor mixture, surrounding said material, is exchanged with ambient air which is heated by a heater.

According to alternative embodiments, the drying method further comprises an Over Drying Phase which occurs between the Drying Phase and the Cooling Phase wherein the air-vapor mixture is circulated around said container, transferring heat from said air-vapor mixture towards a different colder fluid where part of the vapor in said circulated air-vapor mixture condenses and the rest of the said air-vapor mixture is heated by a heater and returned to the container.

According to some embodiments, the physical parameters of the method and the duration of one or more of the Phases are user controllable.

According to further embodiments, excess amount of the air-vapor mixture which is created during the Initial Phase and/or Drying Phase and/or Over Drying Phase is released to the environment.

According to still further embodiments, during the Drying Phase the circulating air-vapor mixture is heated additionally by a heater.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
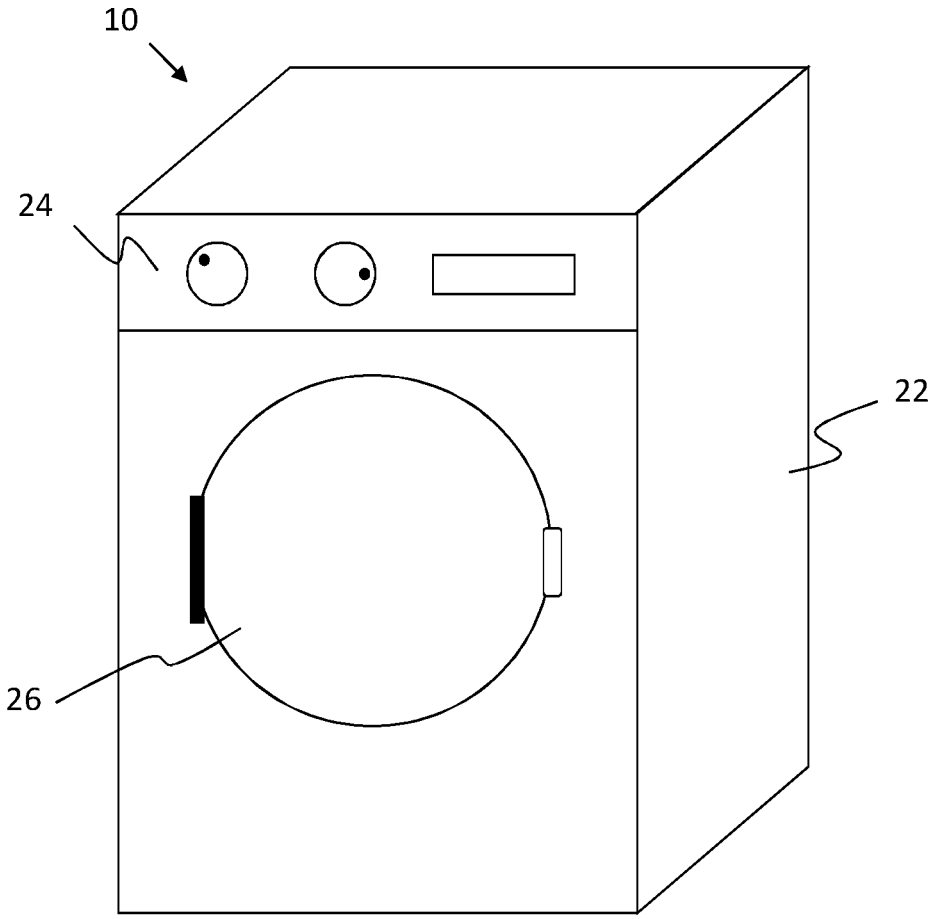
FIG. 1 is a schematic illustration of a dryer, according to an embodiment of the present invention.

It will be appreciated that, for simplicity and clarity of illustration, elements shown in the figures have not necessarily been drawn to scale and can be in various different locations in the Dryer as long as the functionality remains according to embodiments of the present invention. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

Some embodiments of the present invention disclose a dryer, which in some cases can be used to dry fibrous material such as wet laundry. This dryer transfers the latent heat extracted from condensed water and uses this energy indirectly to evaporate water found in the wet laundry. The laundry is typically held in the dryer's drum.

In the "User Phase", the user loads the dryer's drum with wet laundry, and might pre-set some drying parameters. The parameters might include drying time, economy mode and more. The user might be required to verify the cleanliness of filters, empty of water drawer, etc.

After the "User Phase", the dryer starts the "Initial Phase". During this phase, a first air water vapor mixture (AWVM) flow circulates around the drum typically driven by a blower. This first AWVM flow is first heated, typically, by a heater outside the drum and then passed through the laundry in the drum, where it transfers its heat to the laundry. During this phase, the laundry temperature rises, emitting water vapor to the first AWVM flow which may cause the first AWVM flow to expand. To avoid energy and moisture losses due to that expansion, a compressor working in an on/off mode creates a second AWVM flow which evacuates the excess volume from the first AWVM flow to two heat exchangers in series in an open process. The first heat exchanger transfers some of the heat energy of the second compressed AWVM flow to the first AWVM flow. The second heat exchanger cools down the second AWVM flow by a fluid such as air or water which passes through the second heat exchanger. Condensed water in the second AWVM flow accumulates, typically in a designated water drawer or drained through a designated water hose outside the dryer. At the end of the Initial Phase, the first AWVM flow temperature is almost at the water boiling point.

After the "Initial Phase", the dryer begins the "Drying Phase". During this phase, the first AWVM flow continues to circulate around the drum. This first AWVM flow is typically heated in a first heat exchanger outside the drum by the heat from a second compressed AWVM flow (described below) and then passed through the laundry in the drum, where it transfers its heat to the laundry. This heating causes water vapor to be emitted from the laundry to the first AWVM flow. However, the laundry's temperature remains almost constant, because its temperature is close to the water boiling point.

Part of the first AWVM flow is diverted as a second AWVM flow using a compressor working in a continuous mode. The second AWVM flows in a second open process through two heat exchangers in series to a water drawer or a drain hose which is placed in atmospheric pressure. The compression of the second AWVM flow increases its temperature above its condensation temperature; the compression also causes the condensation temperature to be increased.

The second compressed AWVM flow enters the first heat exchanger where some of the heat energy is transferred from the second compressed AWVM flow to the first AWVM flow as mentioned. The pressure in the first heat exchanger is kept above a predefined pressure level higher than the ambient pressure, by a pressure maintaining element such as pressure valve, restrictor, or a turbine which is positioned downstream of the first heat exchanger.

Following the first heat exchanger the second compressed AWVM continues into a second heat exchanger where it is cooled down by a fluid, such as air or water, which passes through the second heat exchanger cooling the second AWVM flow. In some embodiments of the present invention, the second heat exchanger may be positioned upstream of the first heat exchanger. It will be appreciated by those skilled in the art that various configurations in which the second heat exchanger may be located in different locations may be utilized without deviating from embodiments of the present invention. Alternatively, the second heat exchanger functionality can be replaced by allowing heat losses to the environment or in any other suitable way. For simplicity, the following description assumes that second heat exchanger is located downstream of the first heat exchanger, and those having ordinary skill in the art will be able to adapt the description accordingly.

Condensed water in the second AWVM flow accumulates, typically in a designated water drawer or evacuated through a designated water hose outside the dryer.

In some cases, the water evaporation rate from the laundry exceeds the second AWVM flow which evacuates the excess AWVM from the first AWVM flow which may cause the first AWVM to expand. Several options can be implemented in order to avoid energy and moisture losses due to this expansion:

1. use a valve to bypass the pressure maintaining element.
2. adjust the compressor's operation.
3. change the flow rate of the first AWVM flow.

After the "Drying Phase", the dryer may start an "Over Drying Phase". This stage might be initiated by the dryer's controller if the laundry has not met a required drying level. This stage can also be initiated by the user, for example by selecting this program during the User Phase. In the Over Drying Phase, ambient air is blown into the dryer, heated by the said heater and blown over the laundry in order to extract the last remaining water in the laundry. This air absorbs the water and exits the dryer more humid than it was when it entered.

Last, the dryer may begin a "Cooling Phase", in which the laundry is cooled down, typically blowing external fresh air.

After the Cooling Phase, the laundry should be removed from the dryer.

System Description

Although some embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

Figure 2:
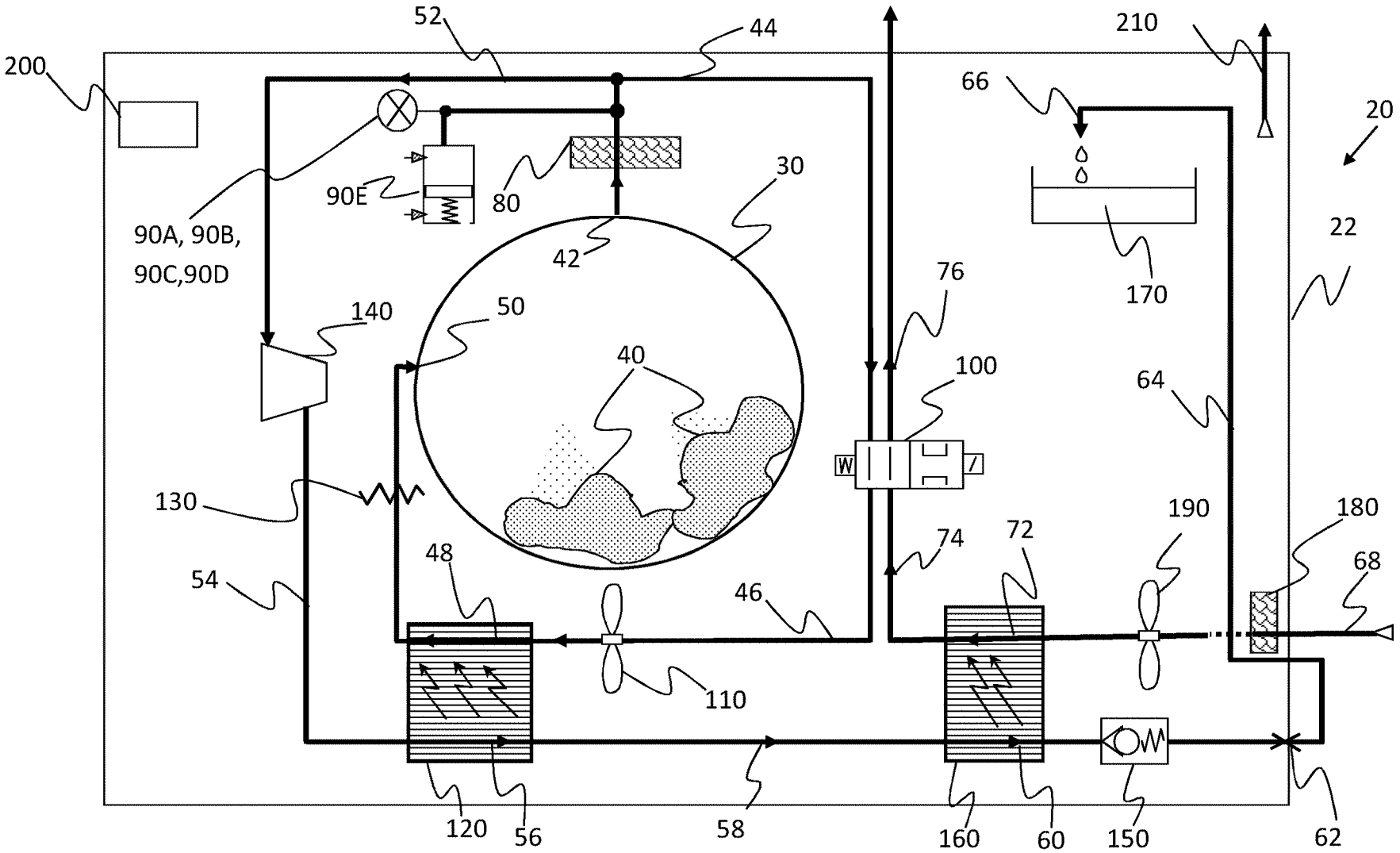
FIG. 2 is a schematic illustration of operational elements topology of a dryer, according to an embodiment of the present invention.

Reference is now made to FIGS. 1 and 2 which are a schematic illustration of a dryer 10 and a schematic illustration of operational elements topology 20 of the dryer 10, respectively, according to a possible embodiment of the present invention.

Dryer 10 may be configured to dry fibrous material, and may be implemented to be used in a domestic, a semi-industrial, or an industrial setting. For simplicity and clarity, except where otherwise stated, the following description is directed to use in a domestic setting wherein typically 8 kg of household fibrous materials, such as linens and clothes, are dried in the dryer and the dryer is operated in conditions comprising typical household temperatures and an atmospheric pressure of approximately one bar. Those having ordinary skill in the art will be able to adapt the description, mutatis mutandis, for other conditions, such as may occur in the semi-industrial or industrial settings referred to above, where the operating temperature of the dryer may be different from typical household temperatures, and where the operating pressure of the dryer may be above or below one bar. In the latter case, the dryer operates in at least a partial vacuum, for instance at 0.2 absolute bar.

Dryer 10 comprises an envelope 22 having controls 24 enabling a user of the dryer to control the operation of the dryer and to choose its drying parameters as stated above. Controls 24 might also include visual and/or audio indicators, providing information to the user, such as: the current phase of the dryer, operation malfunctions, required maintenance signal, etc.

Envelope 22 may comprise pressure tight sealable lid and opening, such as a door 26, via which the materials for drying 40, herein also referred to as wet laundry, may be inserted into the dryer. Door 26 should be adapted to tightly close its opening, in order to provide proper operation conditions. Said door might contain a locking mechanism (not shown in the diagram) which is adapted to prevent opening of the dryer door during the drying process.

The wet laundry is held in a container, such as cylindrical drum that is referred here as a tumbler 30, which is able to rotate about an axis of rotation. Typically, during operation of the dryer, the tumbler is rotated about its axis by a motor, not shown in the diagram. The tumbler 30 is preferably sealed on front and rear sides against the inner side of envelope 22, except for designated openings such as 42, 50. Said tumblers' seals are adapted to prevent the pressure from escaping from tumbler 30. However, if the pressure in the tumbler is lower than the pressure in envelope 22, the sealing may allow air located in the envelope to enter the tumbler. Alternatively the sealing can seal the tumbler in both sides. According to an embodiment, a unidirectional valve may be added (not shown in the drawings) which allows air located in the envelope to enter the tumbler. Operational elements topology of dryer 10 are typically operable by a central processor 200. Typically, processor 200 comprises a general-purpose controller, which is programmed in software to carry out the functions described herein. The software may be downloaded to the processor in electronic form, over a network, for example, or it may, alternatively or additionally, be provided and/or stored on non-transitory tangible media.

A computing device may include a controller that may be, for example, a central processing unit processor (CPU), a chip or any suitable computing or computational device, an operating system, a memory, an executable code, a storage, input devices and output devices. Such controller may be configured to carry out methods described herein, and/or to execute or act as the various modules, units, etc. More than one computing device may be included in a system according to embodiments of the invention, and one or more computing devices may act as the various components of a system. For example, by executing an executable code stored in a memory, a controller may be configured to carry out methods as described throughout the application.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes.

A memory usable for storing programs, control instructions and data may be or may include, for example, a Random Access Memory (RAM), a read only memory (ROM), a Dynamic RAM (DRAM), a Synchronous DRAM (SD-RAM), a double data rate (DDR) memory chip, a Flash memory, a volatile memory, a non-volatile memory, a cache memory, a buffer, a short term memory unit, a long term memory unit, or other suitable memory units or storage units. Such memory may be or may include a plurality of, possibly different memory units. The memory may be a computer or processor non-transitory readable medium, or a computer non-transitory storage medium, e.g., a RAM.

Executable code stored in the memory and executable on the processor may be any executable code, e.g., an application, a program, a process, task or script. The executable code may be executed by the controller, possibly under control of an operating system.

Alternatively or additionally, the controller may be operated hydraulically or pneumatically.

The controller might perform the following actions:

- Convert the user chosen parameters into operation parameters and steps, such as compression rates, flow rates, pre-set timers, etc.
- Monitor some of the thermodynamic characters of the AWVM, using data from sensors in the dryer, for example: temperature sensor, pressure sensor, etc.
- Might activate some of the operational elements topology in the dryer, such as: heater, blowers(s), compressor, audial and/or visual announcement means, etc.
- Make process decisions according to an algorithm which has been incorporated inside the controller.

Some embodiments of the present invention may not use a central processor, and the operational elements topology of the dryer may operate in a semi-independent or fully independent manner.

For simplicity, the following description assumes that dryer 10 comprises a controller 200, and those having ordinary skill in the art will be able to adapt the description when such a processor is a different one or is not present.

In some embodiments of the present invention, the inputs of processor 200 may be dependent on sensing signals from one or more sensors comprised in dryer 10. Sensors 90A, 90B, 90C and 90D, respectively measuring one or more thermodynamic characters, such as: temperature (typically: 10° C. to 130° C.), absolute pressure (typically: 90,000 Pa to 105,000 Pa), differential pressure toward the atmosphere (typically: −300 Pa to 300 Pa), and/or humidity (typically: 10 RH to 100 RH) of AWVM in the dryer, and are incorporated into the dryer. By way of example, such sensors may preferably be mounted downstream tumble outlet line 42 and/or on drum inlet line 50 and/or in any other suitable location. There might be more than one sensor from the same type, and none from other type, as long as the functionality can be maintained.

In some embodiments, an expansion volume sensor device 90E permits the close volume AWVM to expand while water evaporates and/or while air is being heated. Some of the AWVM is located in a closed rigid route, and sensor 90E enables small volumetric expansions or contractions. Those volumetric changes are monitored, and the signal is delivered to said controller.

Sensors 90A, 90B, 90C, 90D and 90E are also referred to herein generically as sensors 90.

In some cases, the dryer may contain additional sensors (not shown in the drawing), such as: Laundry conductivity sensor, in order to estimate the wetness of the laundry; Drawer water level, to avoid flooding that drawer; Door open/close sensor; etc.

The data from some or all of these sensors may be fed into in the controller.

In some cases, the dryer might contain additional indicators (not shown in the drawing) to provide indications, such as: Drawer flooding indicator, Door is open, Current drying stage, etc.

Some or all of these indications may be activated by a controller.

Those having ordinary skill in the art will be able to adapt the described sensors and indications to the current invention.

A selector means 100 may act as a flow selector, which has at least two defined states: a first state allows flow 44 to continue toward flow 46, and allows flow 74 to proceed toward flow 76; a second state allows flow 44 to flow toward flow 76, and allows flow 74 to flow toward flow 46.

In some cases, selector 100 might be positioned in any position between the two defined states above, to define any desired partial-value or partial-amount.

For simplicity, the following description assumes that selector means 100 is a dual selector which has only two defined states which is implemented as a 4×2 electrical dual-selector valve, and those having ordinary skill in the art will be able to adapt the description when such a selector is a different one. The electrical dual-selector valve 100, in its un-energized state, allows flow 44 to flow toward flow 46, and allows flow 74 to flow toward flow 76. In its energized state, it allows flow 44 to flow toward flow 76, and allows flow 74 to flow toward flow 46.

Water drawer 170 collects the condensation water of the drying process both in the Initial Phase and in the Drying Phase. Those phases will be explained in the drying process. The water drawer can be drawn outside the dryer when the drying process is completed. Alternatively, the drainage pipe leading to the drawer can be disassembled at connector 62, and that condensation water will be drained directly outside the dryer, instead of being stored in water drawer 170.

The Dryer may also comprise pump 110 and pump 190 whose main purpose is to urge fluids in a certain direction. For simplicity, the following description assumes that pump 110 and pump 190 are blowers and those having ordinary skill in the art will be able to adapt the description when such a blower is an air pump, steam pump or any other means which can alternatively be used.

In order for heat losses to the environment to be avoided, the Dryer may also comprise thermal isolation (not shown in the diagrams). The thermal isolation might surround one or more of the parts that are hot during the drying process, such as: the drum (30), route leading AWVM flow (44, 46, 52, 54, 58) first heat exchanger (120), etc. Those having ordinary skill in the art will be able to adapt such isolation type and location if those required.

The drying process may contain four stages:

The User Phase (which May be Considered as a Preparation Stage):

The user loads wet laundry into the dryer through door 26, checks the cleanliness of filters 80, 180 and empties water drawer 170 if necessary. The user closes door 26, sets controls 24 and presses, for example, the "Start" button, which may be part of controls 26. When the Phase is over, the controller starts the "Initial Phase".

The Initial Phase:

The wet laundry 40 and the AWVM surrounding it are heated up, typically close to boiling point of water at atmospheric pressure: AWVM, driven by blower 110, flows from tumble outlet 42 toward lint filter 80, proceeds as filtered AWVM toward dual selector valve 100 in its un-energized state, toward heat exchangers channels 48 of heat exchanger 120, from there toward heater 130. The heater heats up the AWVM, and the hot AWVM enters the tumble through inlet 50 forming a closed cycle. Inside the tumble, the AWVM transfers some of its heat to the wet laundry, and cools. The laundry is heated and emits water vapor toward said AWVM.

This process, together with the heating process of the closed cycle AWVM, causes the AWVM to expand or to increase its pressure. Expanding or increasing pressure might cause that closed cycle to leak. In order to avoid losing heat energy and water vapors caused by that leakage, a sub-sequence of releasing AWVM from the closed cycle may occur: The compressor 140 starts urging flow 52 of filtered AWVM compressing it typically to 1.5÷4 bar.

The compressed AWVM 54 enters second set of channels 56 in first heat exchanger 120, continues toward first set of channels 60 inside second heat exchanger 160, where it is cooled down, and typically some of its water vapor condenses. From channels 60, the flow and the condensed water passes through a pressure maintaining device, such as a spring loaded check valve 150, where its pressure is reduced back close to atmospheric pressure. Finally, it flows colder, un-pressurized, and typically mixed with liquid condensed water toward water drawer 170, through outlet 66. The excess air in the envelope 22 can escape outside the envelope through outlet 210 which can be a simple aperture in the envelope.

During the sub-sequence of releasing AWVM from the closed cycle, the compressed hot AWVM located in set of channels 56 transfers heat toward the closed cycle AWVM located at the set of channels 48. This is in addition to heating of the closed cycle AWVM performed by heater 130. To avoid overheating, the heating power of heater 130 is reduced partially or fully.

During the sub-sequence of releasing AWVM from the closed cycle, blower 190 is activated in order to drive, for example, fresh air from inlet 68, which is filtered by filter 180 and flows as fresh cold air through set of channels 72 in said heat exchanger 160. In those channels, the fresh air is heated up by heat transfer from flow 58, as mentioned above, and becomes hot fresh air. This fresh air passes through dual selector valve 100 and finally exits the envelope 22 as flow 76.

If the process parameters values, as received for example from sensor 90 fits pre-set [thermodynamic] process required characters, such as temperature range, for example of 95° C.-99° C., the Initial Phase terminates and the Drying Phase begins.

If the sub-sequence of releasing AWVM does not occur during the whole Initial Phase for a pre-set time, or the Initial Phase does not end by other pre-set time, an error is announced, the Initial Phase terminates and the Cooling Phase begins.

The Drying Phase:

The wet laundry 40 and the AWVM surrounding it have been heated, typically near to water boiling point at atmospheric pressure: AWVM, driven by blower 110, flows from tumble outlet 42 toward lint filter 80, proceeds as filtered AWVM toward dual selector valve 100 in its un-energized state, and from there toward heat exchangers channels 48 of heat exchanger 120, in where it is heated by heat transfer from flow 54. From heat exchanger 120, the AWVM proceeds toward heater 130. The purpose of the heater operation in this phase is to assure that the temperature of the AWVM entering the drum through inlet 50 is typically above the water boiling point. The heater might be operated continuously, non-continuously, or not be operated at all during this phase to assure that the AWVM entering the drum remains within the predetermined temperature range. The AWVM finally enters as filtered and hot AWVM to the tumble through inlet 50 completing the closed cycle.

The compressor 140 works continuously in this phase. It drives and compresses flow 52 of filtered AWVM. The compressed AWVM 54 enters second set of channels 56 in first heat exchanger 120, where it transfers some of its heat toward the set of channels 48 as mentioned. Typically, some of the compressed AWVM flow in channels 56 condenses to liquid water. This mixed flow then continues towards a first set of channels 60 which are part of heat exchanger 160, where the flow cools down, and typically more of its water vapor condenses to liquid water. From channels 60, the compressed AWVM and the condensed water both flow through a spring loaded check valve 150, where their pressure reduces close to the atmospheric pressure. Finally, the AWVM and the condensed water flow toward water drawer 170, through outlet 66. The excess air in the envelope 22 can escape outside the envelope through outlet 210 which can be a simple aperture in the envelope.

During the Drying Phase, the laundry is heated and emits water vapor toward the AWVM. This process, together with the heating process of the closed cycle AWVM, causes the AWVM to expand or to increase its pressure. In case that the expansion rate is higher than the flow rate of flow 52, the closed loop might leak. In order to avoid losing heat energy and water vapors caused by that leakage, a sub-sequence of releasing AWVM from the close cycle may occur. For example, by changing the compression rate of compressor 140 or by changing its speed, or by changing the flowrate of blower 110.

During the Drying Phase, blower 190 is activated in order to drive fresh air from inlet 68, which is filtered by filter 180, and flows as a cold fresh air through set of channels 72 in said heat exchanger 160. In those channels, the fresh air is heated up by heat transfer from flow 58 and becomes hot fresh air. The hot fresh air passes through dual selector valve 100 and exits the envelope 22 as flow 76.

During the Drying Phase, the controller 200 monitors one or more of the operation parameters indicated by sensor 90. If data from sensor 90 fits preset thermodynamic character, the Drying Phase terminates and the Over Drying Phase or the Cooling Phase begins (see detailed description of such conditions and preset values herein below with respect to FIGS. 6A-6D).

If the Drying Phase does not end by a preset time, an error may be announced, the Drying Phase may terminate and the Cooling Phase may begin.

The Over Drying Phase:

During the Over Drying Phase, the compressor does not operate, but the heater 130, blower 190 and/or blower 110 are operated and dual selector valve 100 is energized.

Fresh air, driven by one or two of blowers 110, 190 enters inlet 68, is filtered by filter 180, passes through set of channels 72 in heat exchanger 160, passes as flow 74 through the energized dual selector valve 100, exits as flow 46, enters second set of channels 48 in heat exchanger 120, passes heater 130 where its heated up and finally enters as hot, dry and filtered air to tumble 30 through entrance 50. The hot and dry air absorbs the last remaining water in laundry 40 and exits the tumble through exit 42 as colder and humid flow 44 toward dual selector valve 100 outward the envelope 22 to the environment as flow 76.

During the Over Drying Phase, the controller 200 monitors one or more of the thermodynamic characters in sensor 90. It may operate the heater continuously non-continuously, or any other method of operation to avoid laundry from over-heating above a preset temperature. Thermodynamic characters of AWVM leaving the drum might be monitored using data from sensor 90.

If data from sensor 90 fits per-set thermodynamic character and behavior, such as temperature has reached 120° C. for 5 times, the Over Drying Phase terminates.

If the Over Drying Phase does not end by a pre-set time, an error is announced, the Over Drying Phase terminates, and the Cooling Phase begins.

The Cooling Phase:

The compressor and the heater do not operate, but blower 190 and/or blower 110 are operated, and dual selector valve 100 is energized.

Fresh air, driven by one or two of blowers 110, 190 enters inlet 68, is filtered by filter 180, passes through set of channels 72 in heat exchanger 160, passes as flow 74 through the energized dual selector valve 100, exits as flow 46, enters second set of channels 48 in heat exchanger 120, passes heater 130 and finally enters as cold filtered fresh air to tumble 30 through entrance 50. The cold filtered fresh air cools down the laundry in tumble 30 and exits the tumble through exit 42 as hotter flow 44 toward dual selector valve 100 outward the envelope 22 to the environment as flow 76.

During the Cooling Phase, the controller 200 monitors one or more of the thermodynamic characters in sensor 90. If data from sensor 90 fits per-set thermodynamic character, such as temperature of 40° C.-60° C., the Cooling Phase terminates.

If the Cooling Phase does not end by a pre-set time, an error is announced, and the Cooling Phase terminates.

Figure 3:
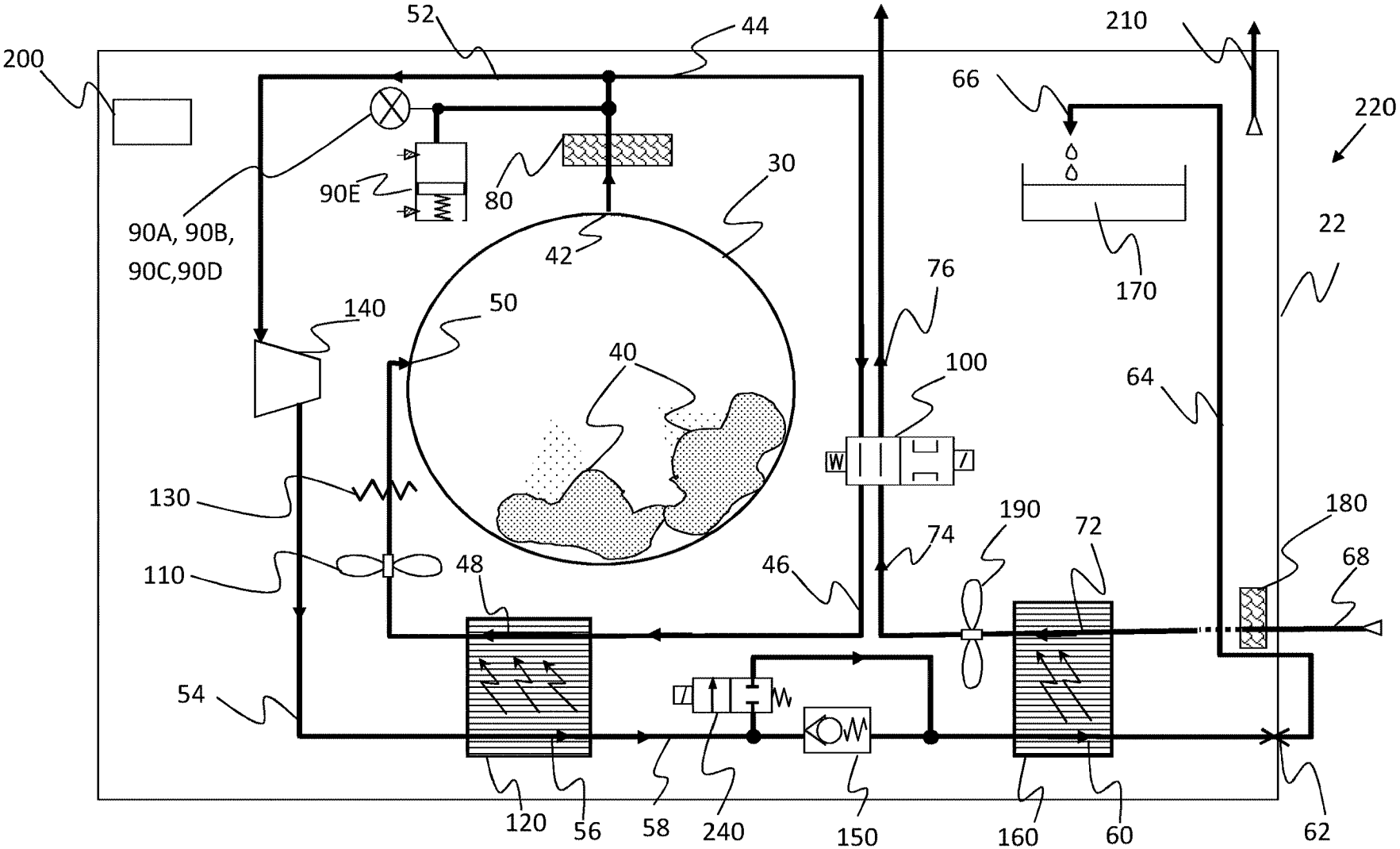
FIG. 3 is a schematic illustration of operational elements topology of a dryer, according to a variation of the present invention.

FIG. 3 is a schematic illustration of other possible implementation of operational elements topology 220 of dryer 10, according to an embodiment of the present invention. Apart from the differences described below, operational elements topology 220 in FIG. 3 of dryer 10 are generally similar to operational elements topology 20 described above (FIGS. 1 and 2) and operational elements topology indicated by the same reference numerals are generally similar in their operation.

As can be seen in FIG. 3, the locations of operational elements topology such as: blowers 110, 190, spring loaded check valve 150 are altered in reference to their location in operational elements topology 20, and those having ordinary skill in the art will be able to adapt these and other elements' locations under the current invention according to mechanical, thermo-dynamical, operational and/or economic considerations.

In addition to the position alteration, another operational element was added: a two states selection valve 240. Element 240 can be implemented as a 2×2 normally closed solenoid valve, ball valve, [actuator], or any other implication that meets its functionality. For simplicity, the following description assumes that device 240 comprise a 2×2 normally closed solenoid valve, and those having ordinary skill in the art will be able to adapt the description when such a valve is a different one.

Device 240, in its un-energized state, is closed. In its energized state, it allows flow 58 to by-pass the spring loaded check valve 150, and by that, to reduce pressure in the compressed AWVM flow below the pressure check valve 150 is set to maintain in that flow.

The dryers operational elements topology and phases are similar to those described above (FIGS. 1, 2) except that, when AWVM pressure release is required in the Initial Phase and/or in the Drying Phase, the compressor 140 does not necessarily need to change its compression rate, and blower 110 should not necessarily need to change its flow rate.

When valve 240 is energized, the spring loaded check valve 150 is bypassed, and the compressor motivates flows 52, 54 and 58 to flow through outlet 66 typically in higher flowrate in order to release excess volume from the closed cycle AWVM. During this process, the compressor does not create a significant pressure, i.e., heat exchanging in heat exchanger 120 becomes negligible, flow 46 is not reheated significantly in the heat exchanger, and the evaporation rate of new water vapor from the laundry slows down and even ceases.

The compressor motivated AWVM passes through heat exchanger 160, wherein flow 58 cools down and most of its water content condenses and is stored in drawer 170.

Figure 4:
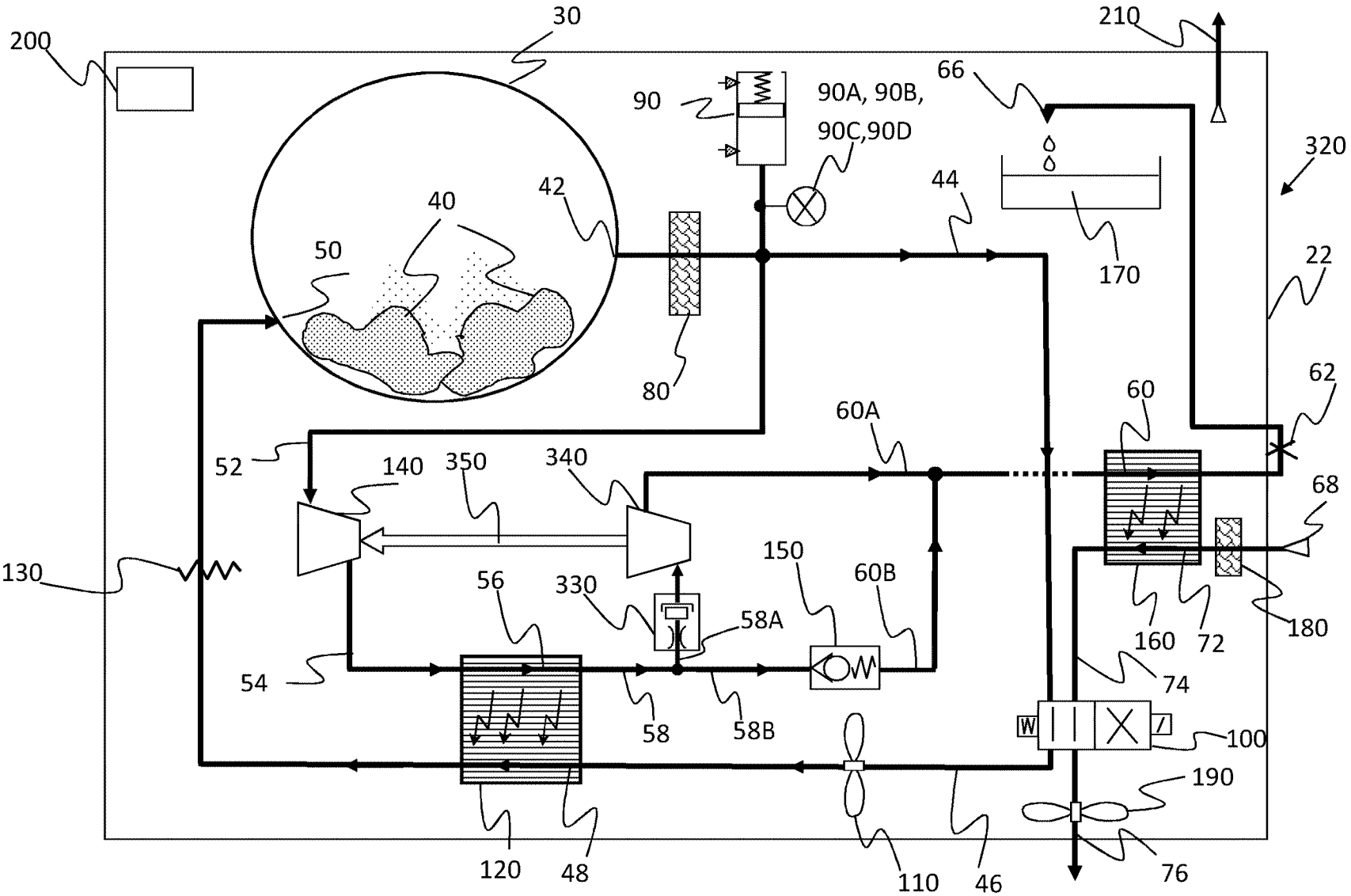
FIG. 4 is a schematic illustration of operational elements topology of a dryer, according to an alternative embodiment of the present invention.

FIG. 4 is a schematic illustration of operational elements topology 320 of dryer 10, according to an alternative embodiment of the present invention. Apart from the differences described below, operational elements topology 320 of dryer 10 are generally similar to operational elements topology 20 described above (FIGS. 1 and 2) and elements indicated by the same reference numerals in both elements 320 and 20 are generally similar in their operation.

As can be seen in FIG. 4, the locations of operational elements such as: blowers 110, 190, spring loaded check valve 150 are altered in reference to their location in operational elements topology 20, and those having ordinary skill in the art will be able to adapt these and other elements' locations under the current invention according to mechanical, thermo-dynamical, operational and/or economic considerations.

In addition to the operational elements topology 20 described above, the operational elements topology 320 in FIG. 4 also comprises a turbine 340, a gas-liquid separator 330, and might also comprise a mechanical energy recovery transfer unit 350 as explained below.

The compressed AWVM flow 58 might contain condensed liquid water due to the fact that some heat from the compressed AWVM flow 54 was transferred to the closed cycle AWVM flow 46 in heat exchanger 120. The gas-liquid separator 330 enables the AWVM from flow 58 to flow through turbine 340 as flow 58A, and enforces the condensed liquid portion of flow 58 to flow toward spring loaded check valve 150, as flow 58B.

Flow 58A feeds turbine 340. The pressure differential between both sides of the turbine enables the turbine to recover part of the pressure energy of flow 58A. The recovered energy may be used to partially energize compressor 140, as is illustrated schematically by an arrow 350, typically, although not necessarily, by configuring the turbine and the compressor to have a common drive shaft. Alternatively, the recovered energy can be transferred into electricity or any other form of re-used energy. The presence of turbine 340 enables to operate compressor 140 at higher flow rates. This increases the heat convection factor of the AWVM flowing in channels 56 with minimal loss of pressurizing energy. The fact that the turbine recovers the pressurized energy of the compressed air portion of the AWVM allows the AWVM to operate at a lower temperature then in the configurations presented in FIGS. 2-3 such as 60° C.-80° C. with almost similar energetic efficiency as in the previous configurations explained above.

Flow 58A exits the turbine as flow 60A and unites with flow 60B that exits spring loaded check valve 150. Both flow toward set of channels 60 in heat exchanger 160.

In some embodiment of the present invention, the compressor 140, the turbine 340 and the common drive-shaft might be implemented by a turbo-charger combined with an external drive.

In some embodiments of the present invention, flow 76 is introduced into the inner volume of envelope 22 (not shown in the diagram) and the inner air inside envelope 22 can escape through outlet 210.

The rest of the functionality of operational elements topology 320 is the same as the functionality of operational elements topology 20, as well as the drying process.

Figure 5:
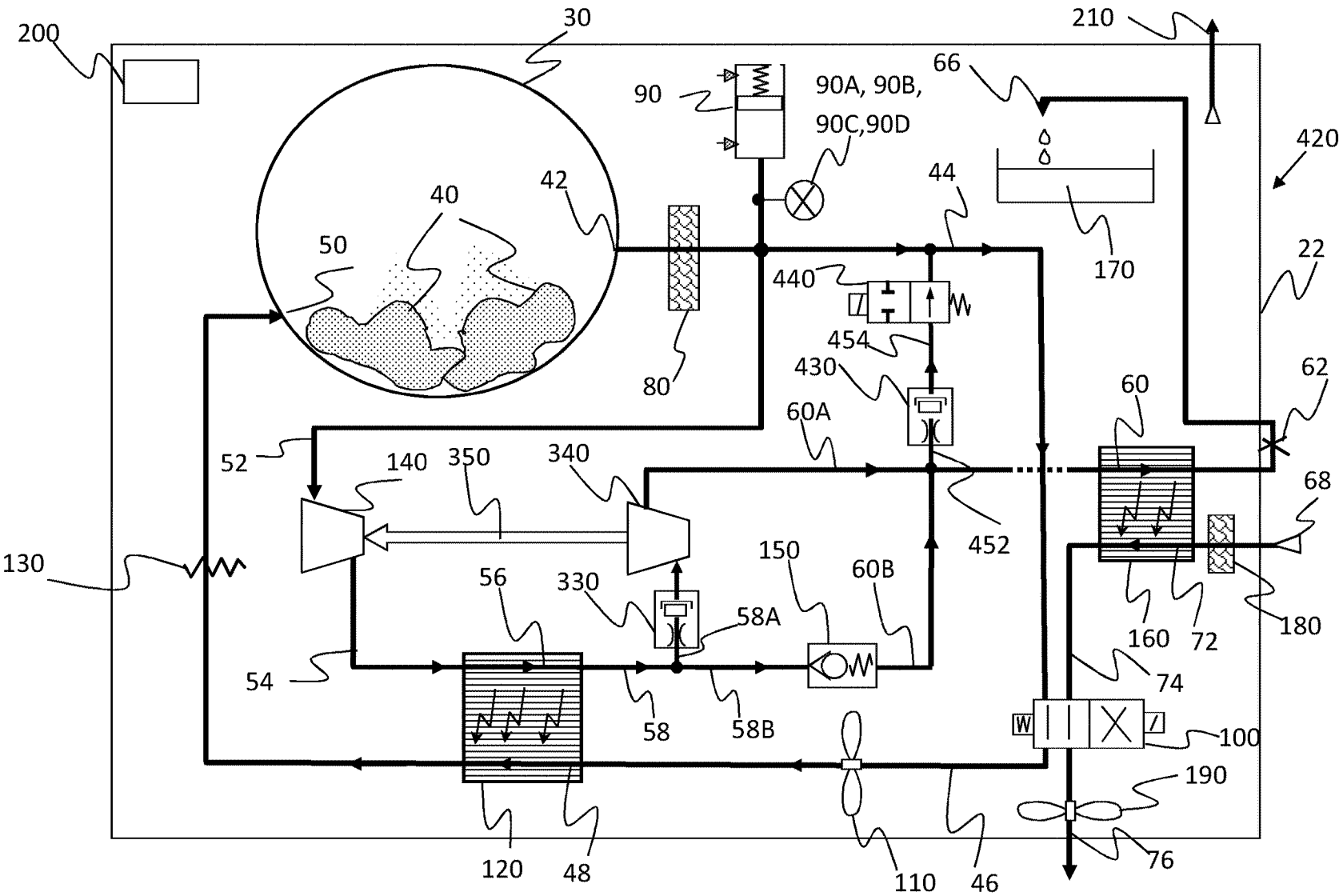
FIG. 5 is a schematic illustration of operational elements topology of a dryer, according to yet another alternative embodiment of the present invention.
Figure 6A:
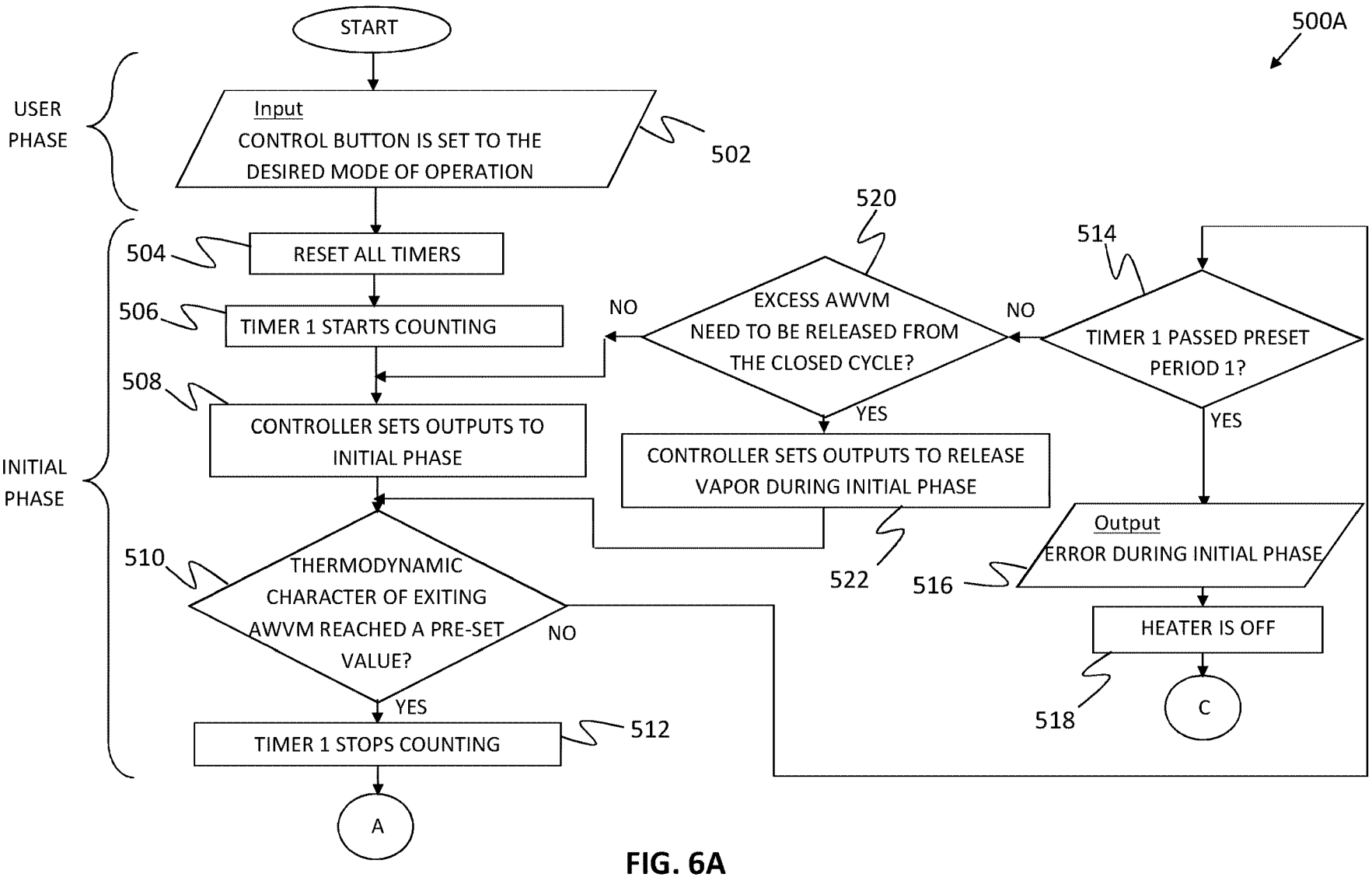
FIGS. 6A, 6B, 6C and 6D are a flowchart of a drying process implemented in a typical operation of the dryer, according to an embodiment of the present invention.
Figure 6B:
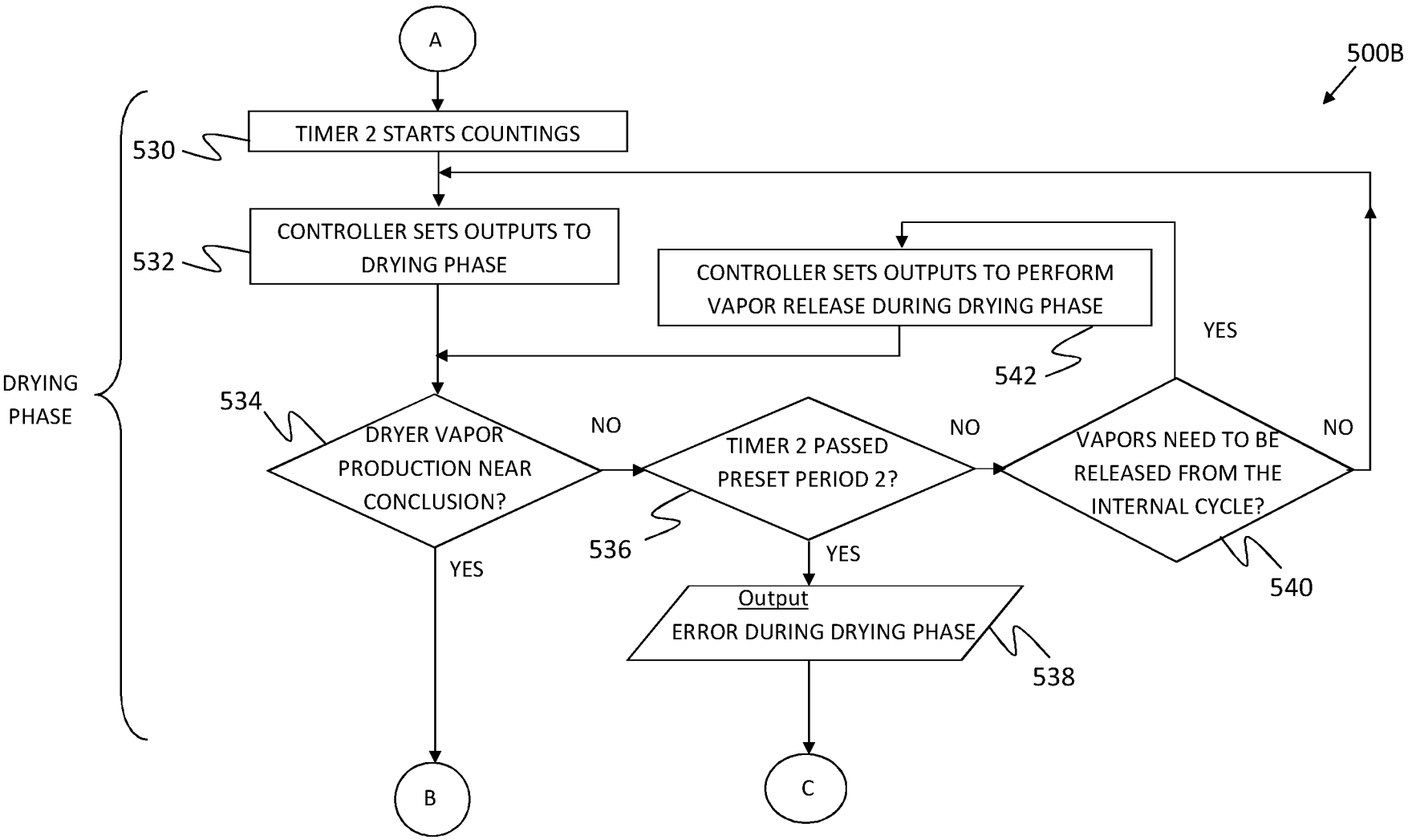
Figure 6C:
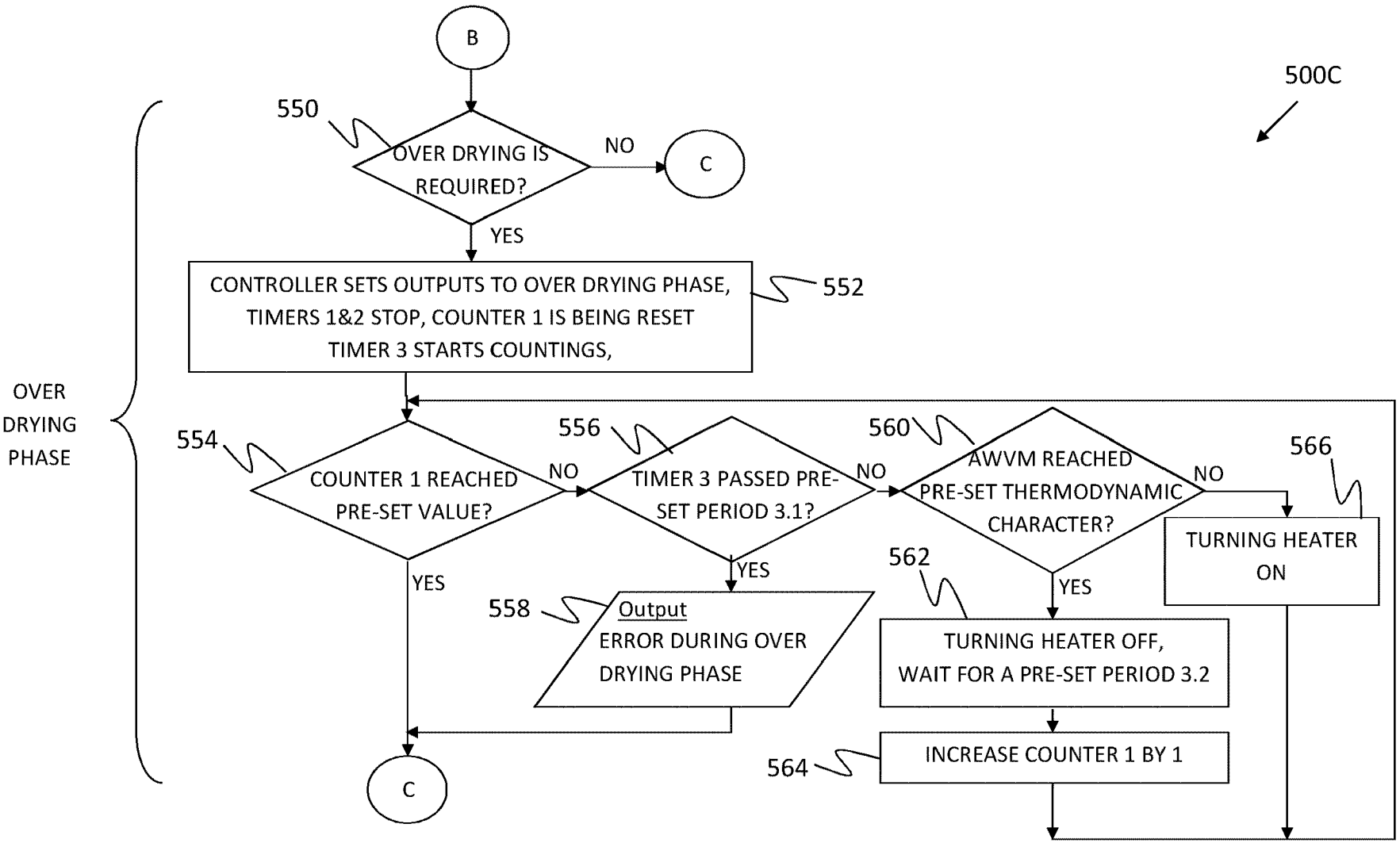
Figure 6D:
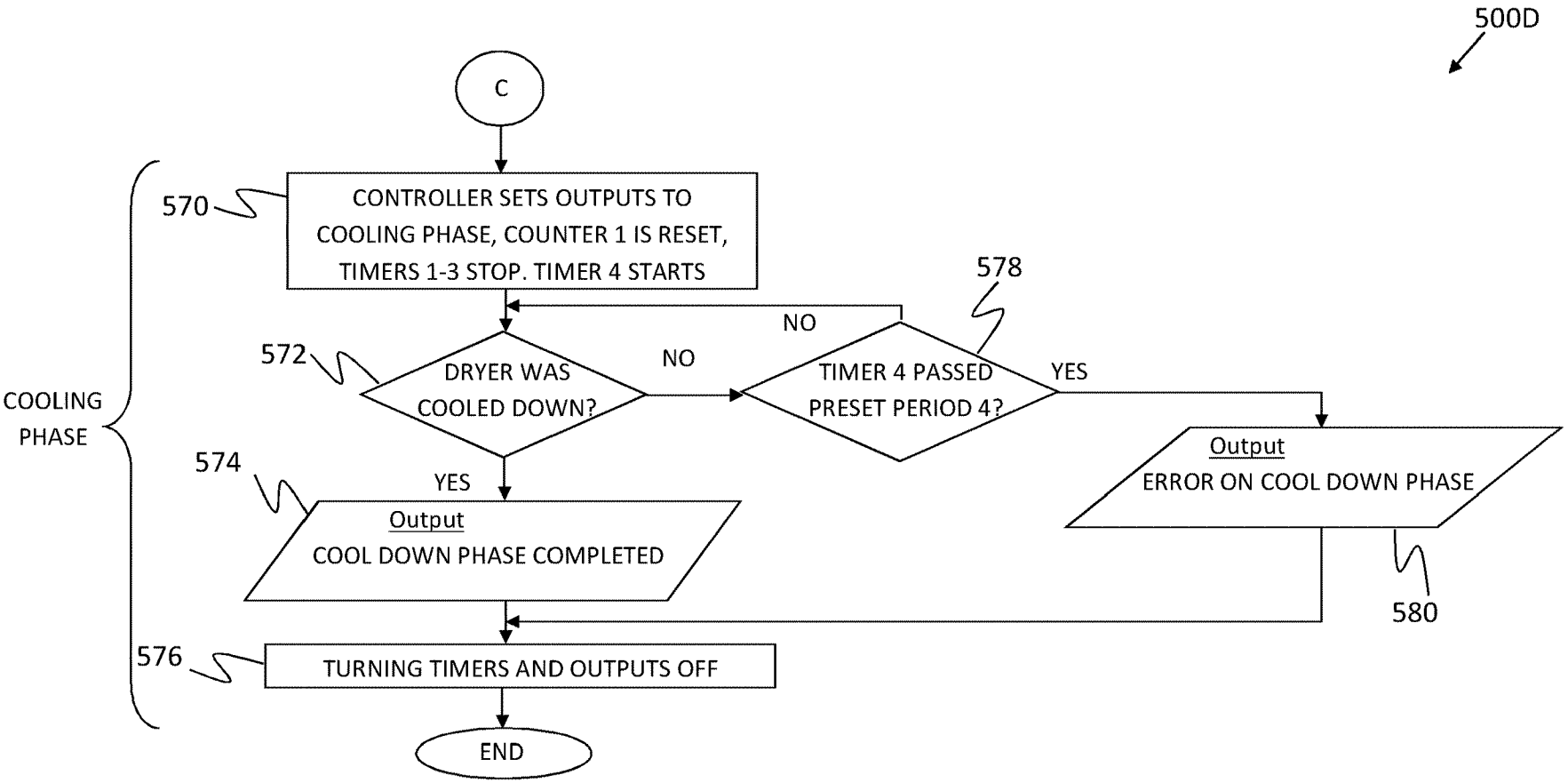

FIG. 5 is a schematic illustration of operational elements topology 420 of dryer 10, according to an alternative embodiment of the present invention. Apart from the differences described below, operational elements topology 420 of dryer 10 are generally similar to operational elements topology 320 described above (FIG. 4) and elements indicated by the same reference numerals in both elements 420 and 320 are generally similar in their operation.

The location of operational elements in topology 420 of dryer 10 such as: blowers 110, 190, spring loaded check valve 150 can be altered in reference to their location in operational elements topology 320, and those having ordinary skill in the art will be able to adapt these and other elements' locations under the current invention according to mechanical, thermo-dynamical, operational and/or economic considerations.

In addition to the operational elements topology 320 described above, the operational elements topology 420 in FIG. 5 also comprise a second gas-liquid separator 430, and an additional 2 states selection valve 440.

Element 440 can alternatively be implemented as a solenoid valve, ball valve, actuator, or any other implication that meets is functionality. For simplicity, the following description assumes that element 440 comprise a 2×2 normally open electrical solenoid valve, and those having ordinary skill in the art will be able to adapt the description when such a valve is a different one.

In case the solenoid valve 440 is in its un-energized state, the second gas-liquid separator 430 allows the gaseous portion of flows 60A and 60B to continue as flow 452 toward flow 454, and from there, the flow is joined with flow 44 of the closed cycle AWVM as hot and humid AWVM. The liquid portion of flows 60A and 60B are joined and continue toward the set of channels 60 of heat exchanger 160.

In case the solenoid valve 440 is in its closed state (energized), the second gas-liquid separator 430 cannot separate the gas-liquid mixture of flows 60A and 60B, and those joint flows continue toward the set of channels 60 of heat exchanger 160.

The dryer's operational elements topology and phases are similar to those described with respect to FIGS. 1 and 4 except for the fact that, when AWVM pressure release is required in the Initial Phase and/or in the Drying Phase, the compressor 140 does not necessarily need to change its compression rate, and blower 110 does not necessarily change its flow rate. Instead, valve 440 can be energized, and compressor 140 motivate flows 52, 54, 58, 60A, 60B to exit through outlet 66 in order to release excess volume from the closed cycle AWVM. The flow in set of channels 60 inside heat exchanger 160 is cooled by the environmental fresh air and some of the water vapor content in that flow condenses before being directed to the water drawer 170.

The rest of the functionality of operational elements topology 420 is the same as the functionality of operational elements topology 320, as well as the drying phases.

FIGS. 6A, 6B, 6C and 6D contain one flowchart that is divided into four parts: 500A, 500B, 500C and 500D respectively.

The flowchart describes a drying process implemented in a typical dryer, such as dryer 10, according to some embodiments of the present invention. The flow chart will be explained, for example, in reference to dryer 10 and to operational elements topology 20, 220, 320, and 420 that are shown in FIGS. 1-5. For simplicity, the following description assumes that dryer 10 comprise a general-purpose controller 200, and those having ordinary skill in the art will be able to adapt the description when such a processor is a different one, or not present.

As seen in FIGS. 6A, 6B, 6C and 6D, the drying process contains five major phases:

The User Phase:

In step 502, wet clothes may be loaded into the Drier, the load door maybe tightly closed and the control button may be set to the desired mode of operation.

The Initial Phase:

The Initial phase begins in step 504, wherein the controller resets all timers, and in next step 506, timer 1 begins to count the time period of the Initial Phase. In step 508, the controller sets the operational parameters values which are required for the Initial Phase: User interface outputs indicators (if those exist), blower 110, heater 130, drum motor (not shown in the diagrams) are all turned on, and all other outputs such as compressor 140, dual selector valve 100 etc. are turned off. Next, in condition step 510, the controller checks whether a thermodynamic character of AWVM exiting the drum reached a pre-set value. This can be deduced, for example, using the temperature signal from element 90A and checking whether that temperature reached its target, and/or it can check whether the relative humidity signal from sensor 90D is high enough. Alternatively, or additionally, the controller can use the volume sensor signal from sensor 90E. In this case, when step 522 exceeds more than a pre-set duration for example 5-10 minutes, and the signal from volume sensor 90E indicates that the volume is still expanding, the controller can deduce in step 510 that the content of the AWVM exiting the drum is close to the boiling point of water. Any other suitable pre-set value and sensor signal can be used to verify that the laundry and the water it contains are hot enough.

If the controller deduces that the content of the AWVM exiting the drum is hot enough, timer 1 stops counting (step 512), the Initial Phase ends and the Drying Phase begins (at step 530). If the controller deduces that the content of the AWVM exiting the drum is not hot enough, conditioning step 514 begins.

Conditioning step 514 checks whether timer 1 passed a pre-set period 1, for example 20 minutes. The check is meant to verify that the Initial Phase will not continue without boundary, in case that there is a leak or malfunction in the system. If the Initial Phase exceeds above pre-set period 1, an error notification (step 516) to the user might be announced. This notification can be a visual or audial announcement. Then, the heater is turned off (step 518), the Initial Phase ends and the Cooling Phase begins (at step 570).

Back to conditioning step 514, if the Initial Phase timer did not reach a pre-set period 1, conditioning step 520 begins, in which the controller checks whether excess AWVM needs to be evacuated from the closed cycle described above (see FIGS. 1 and 2 description).

The controller can use, for example, the signals of a volume sensor 90E or the signal from a differential pressure 90C or any other signal from suitable sensor to deduce whether excess AWVM need to be released from the closed cycle.

If the controller deduces that AWVM needs to be released from the closed cycle, the controller sets the outputs to release vapor during the Initial Phase (522). In this step, the compressor 140 and blower 190 are turn on in order to evacuate excess AWVM from the close cycle through a second flow as described above (see FIGS. 1 and 2 description). In some embodiments, valves 240 or valve 440 (if exist) might also be activated. After step 522, the controller returns to step 510.

Back to conditioning step 520, if the controller deduced that AWVM does not need to be released from the closed cycle, the controller returns to step 508.

The Drying Phase:

The Drying phase begins in step 530, wherein timer 2 begins to count the time period of the Drying Phase. In step 532, the controller sets the output which are required for the Drying Phase: User interface outputs (if those exist), blower 110, drum motor (not shown in the diagrams), compressor 140 and blower 190 are turned on, and all the other outputs are turns off. The heater might be operated continuously, non-continuously, or not be operated at all in this phase. The purpose of the heater operation in this phase is to assure that the temperature of the AWVM entering the drum in inlet 50 is hot enough. For this deduction, the controller uses a thermodynamic feedback from sensor 90.

Next, in condition step 534, the controller checks whether the water vapor production in the dryer is almost concluded. For deducing that, the controller reads the temperature signal from element 90A and checks whether that temperature is reduced below a preset temperature, or, alternatively it can check whether the relative humidity signal received from sensor 90D is too low. Alternatively or additionally, the controller can use the volume sensor signal from sensor 90E. In this case, when the signal from volume sensor indicates that no volume expansion occurred for a pre-set period of time, the controller can deduce that the water vapor content in the closed cycle AWVM is low. Any other suitable pre-set value and sensor signal to verify that the water vapor content in the closed cycle AWVM is low can be used.

If the controller deduces that the water vapor content in the closed cycle AWVM is low, the Drying Phase ends and the Over Drying Phase begins (at step 550). If the controller deduces that the water vapor content in the closed cycle AWVM is not low, conditioning step 536 begins.

Conditioning step 536 checks whether timer 2 passed a pre-set period 2, for example 120 minutes. This check verifies that the Drying Phase will not continue endlessly, in case that there is a leak or malfunction in the system. If the Drying Phase exceeds pre-set period 2, an error notification to the user might be announced (Step 538). This notification can be a visual or audial announcement. Then, the Drying Phase ends, and the Cooling Phase begins (at step 570).

Back to conditioning step 536, if the Drying Phase timer (timer 2) did not reach a pre-set period 2, conditioning step 540 begins, in which the controller checks whether AWVM needs to be released from the closed cycle described above.

The controller can use, for example, the signals of a volume sensor 90E or the signal from a differential pressure 90C or any other signal from suitable sensor to deduce whether AWVM needs to be released from the closed cycle.

If the controller deduced that AWVM needs to be released from the closed cycle, the controller sets the outputs to perform vapor release during the Drying Phase (542). In that step, the compressor 140 might change its compression rate, its speed, or any other suitable parameter in order to evacuate excess AWVM from the close cycle through a second flow as described above. In some embodiments, valves 240 or valve 440 (if exist) might also be activated. After step 542, the controller returns to conditioning step 534.

Back to conditioning step 540, if the controller deduced that AWVM does not need to be released from the closed cycle, the controller returns to step 532.

The Over Drying Phase:

The Over Drying Phase begins in conditioning step 550, in which the controller checks whether over drying is required: if the user required it (typically by setting adequate controls in the User Phase) or if the laundry is not dry enough, e.g., relative humidity of AWVM is still high and a preset relative humidity level or the conductivity of the laundry is still high.

In conditioning step 550, if the Over Drying Phase is not required, the Over Drying Phase terminates and the cooling phase begins (Step 570).

If Over Drying is required, step 552 begins, wherein blower 110 and/or blower 190 are turned on, energizing dual selector 100, keeping the drum motor on, keeping the user interface outputs on (if those exist) and turning off all other outputs. In addition, timer 3 begins to count the Over Drying Phase time period, timers 1 and 2 are off, and counter 1 is reset. Counter 1 represents the number of heating cycles.

Next, conditioning step 554 checks whether counter 1 reached the pre-set value which represents the target number of heating cycles for example 5 counts.

If counter 1 has not reached that pre-set value, the conditioning step 556 begins, in which the controller checks whether the Over Drying Phase proceeds beyond a pre-set period 3.1 (timeout) for example 20 minutes. If timer 3 has passed the pre-set period 3.1, an error notification to the user might be announced (Step 558). This notification can be a visual or audial announcement. Then, Over Drying Phase terminated and the Cooling Phase begins (at step 570).

Back to conditioning step 556, if timer 3 has not passed the pre-set period 3.1, conditioning step 560 begins.

Conditioning step 560 checks whether the thermodynamic character of the AWVM leaving the drum has reached a certain value, for example, if the temperature of the AWVM, measured in sensor 90A is greater than 120° C.

If the thermodynamic character of the AWVM leaving the drum has reached that certain value, the heater is turned off for a pre-set period 3.2 (step 562), typically 5 minutes, the counter 1 is increased by 1 unit (step 564), and conditioning step 554 begins.

If the thermodynamic character of the AWVM leaving the drum has not reached that certain value, the heater is turned on (step 566) and conditioning step 554 begins.

Back to conditioning step 554, if counter 1 has reached the pre-set value, the Over Drying Phase terminates and the Cooling Phase begins (step 570).

The Cooling Phase:

The Cooling Phase begins in step 570, wherein blower 110 and/or blower 190 are turned on, energizing dual selector valve 100, keeping the drum motor on, keeping user interface outputs on (if those exist) and turning off all other outputs. In addition, counter 1 is reset, timer 4 begins to count the Cooling Phase time period, and timers 1, 2 and 3 are off.

Next, in condition step 572, the controller checks whether the AWVM leaving the drum is cold enough. For deducing that, typically it can use the temperature signal from element 90A and check weather that temperature was reduced to below 40° C.-60° C. or, alternatively it can check any other suitable pre-set value and sensor signal to verify that that AWVM was cooled.

If the controller deduces that the AWVM leaving the drum is not cold enough, conditioning step 578 begins.

Conditioning step 578 checks whether timer 4 passed a pre-set period 4, for example 20 minutes. The check is meant to verify that the Cooling Phase will not continue endlessly, in case that there is a malfunction in the system. If the Cooling Phase exceeds pre-set period 4, an error notification to the user might be announced. This notification can be a visual or audial announcement (step 580), and step 576 begins.

Back to conditioning step 578, if the Cooling Phase timer (timer 4) did not reach a pre-set period 4, conditioning step 572 begins.

Back to conditioning step 572, if the controller deduces that the AWVM leaving the drum is cold enough, step 574 begins, in which a notification to the user might be announced which indicates that the Dryer has completed its program. It can be a visual or audial announcement. Next, timers and outputs are turned off (step 576), the Cooling Phase ends, and the program terminates.

While certain features of the present invention have been illustrated and described herein, many modifications, substitutions, changes, and equivalents may occur to those of ordinary skill in the art. It is, therefore, to be understood that the appended claims are intended to cover all such modifications and changes as fall with the true spirit of the invention.

The invention claimed is:

1. A method, comprising:

in an initial phase, circulating an air-vapor mixture over material to be dried in a container while heating the circulating air-vapor mixture with a heater;

in a drying phase occurring after the initial phase:

circulating the air-vapor mixture over the material to be dried in the container, compressing a portion of said circulating air-vapor mixture, heating said circulating air-vapor mixture by a first heat portion of said compressed portion; and transferring a second portion of the heat originating from the compressed portion of said circulating air-vapor mixture towards a different colder fluid; and in a cooling phase occurring after the drying phase, removing heat from the material to be dried in the container with one of exchanging the circulating air-vapor mixture surrounding said material with ambient air or transferring heat from said circulating air-vapor mixture towards said different colder fluid, further comprising, an over drying phase which occurs between the drying phase and the cooling phase wherein said circulating air-vapor mixture surrounding said material is exchanged with ambient air which is heated by a heater.

2. The method according to claim 1, wherein the air-vapor mixture is circulated around said container transferring heat from said circulating air-vapor mixture towards said different colder fluid where part of the vapor in said circulating air-vapor mixture condenses and the rest of the said circulating air-vapor mixture is heated by the heater and returned to the container.

3. The method according to claim 2 wherein during the Drying Phase, said circulating air-vapor mixture is heated additionally by said heater.

4. The method according to claim 1 wherein excess of said circulating air-vapor mixture which is created during the initial and/or drying phase is released to an environment.

5. The method according to claim 1 which includes means which prevents direct exposure of living beings to hot components and/or fluid.

* * * * *